US011324271B2

(12) United States Patent
Chai

(10) Patent No.: US 11,324,271 B2
(45) Date of Patent: May 10, 2022

(54) INNER BUFFERING STRUCTURE OF HELMET

(71) Applicant: EVERMAX ECO INDUSTRY LTD., Zhejiang (CN)

(72) Inventor: Swo-Chung Chai, Zhejiang (CN)

(73) Assignee: EVERMAX ECO INDUSTRY LTD.

( * ) Notice: Subject to any disclaimer, the term of this patent is extended or adjusted under 35 U.S.C. 154(b) by 306 days.

(21) Appl. No.: 16/658,152

(22) Filed: Oct. 20, 2019

(65) Prior Publication Data

US 2021/0112903 A1 Apr. 22, 2021

(51) Int. Cl.

| | |
|---|---|
| ***A42B 3/04*** | (2006.01) |
| ***A42B 3/28*** | (2006.01) |
| ***A42B 3/08*** | (2006.01) |

(52) U.S. Cl.

CPC ..... *A42B 3/0486* (2013.01); *A42B 3/08* (2013.01); *A42B 3/28* (2013.01)

(58) Field of Classification Search

CPC ..... A42B 3/069; A42B 3/122; A42B 3/08; A63B 71/10; A63B 71/081

See application file for complete search history.

(56) References Cited

U.S. PATENT DOCUMENTS

| | | | | |
|---|---|---|---|---|
| 3,994,021 | A * | 11/1976 | Villari | A42B 3/125 2/413 |
| 6,178,560 | B1 * | 1/2001 | Halstead | A42B 3/122 2/413 |
| 11,051,572 | B2 * | 7/2021 | Klein | A42B 3/122 |
| 2002/0166157 | A1 * | 11/2002 | Pope | A42B 3/122 2/413 |
| 2019/0125025 | A1 * | 5/2019 | Williams | A42B 3/122 |
| 2020/0275721 | A1 * | 9/2020 | Vanhoutin | A63B 71/10 |

* cited by examiner

*Primary Examiner* — Katherine M Moran

(57) ABSTRACT

An inner buffering structure of a helmet comprising an air bladder, wherein the air bladder comprises a detachable inner-layer air bladder and an outer-layer air bladder, and the inner-layer air bladder is used for being in contact with a user's head; a plurality of ventilation openings is formed in the inner-layer air bladder and the outer-layer air bladder; the portions where the inner-layer air bladder and the outer-layer air bladder correspond to the ventilation openings are provided with inner convex edges extending towards the interior of the ventilation openings; a first air valve is arranged on the inner-layer air bladder, a second air valve is arranged on the outer-layer air bladder, and a reserved hole allowing the first air valve to pass through is formed in the outer-layer air bladder.

18 Claims, 4 Drawing Sheets

INNER BUFFERING STRUCTURE OF HELMET

TECHNICAL FIELD OF THE INVENTION

The present invention relates to the technical field of helmets, and more particularly, to an inner buffering structure of a helmet.

BACKGROUND OF THE INVENTION

A helmet is a tool used for head protection. It can be a cap worn by a soldier in training and combat, an indispensable tool for motorcyclists and bicyclists, or a protective device for people in sports and games.

In the prior art, traditional helmets normally include a hard shell, a flexible lining and a fixing strap used for fixing on the head. The shell protects a user's head from being damaged when sliding on the ground and the lining enables the portion in contact with the user's head to be soft and comfortable. Some helmets have their linings directly fixed in the shells, and thus there's no buffer between the linings and the shells. Although damages caused by sliding can be avoided by the shell when accidents happen, damages caused by direct hard collision are inevitable. Some shells are provided with mesh-pattern plastic strips, and the linings are arranged on the surfaces of the plastic strips. Under such circumstances, the buffering material in the lining can easily move into the gaps between the mesh-pattern plastic strips after prolonged use, making a user's head feel uncomfortable.

Some helmets are equipped with air bladders, but cannot fit users' heads. Even if a buffering effect can be achieved, the air permeability is poor. With the rise of the sharing economy, shared helmets are promoted in some cities. However, health and safety problems can also be caused by helmets shared by many people. For instance, many people are adverse to sharing someone's helmet due to sanitation concerns.

SUMMARY OF THE INVENTION

The purpose of the present invention is to solve the shortcomings in the prior art by providing a novel helmet having double layers of air bladders, wherein the inner-layer air bladder and the outer-layer air bladder are provided with ventilation openings for achieving an ideal air permeability, and the inner-layer air bladder can be removed from the outer-layer air bladder. The outer-layer air bladder is for public use, and the inner-layer air bladder is for private use. When being used by different users, only the user's own inner-layer air bladder needs to be mounted, achieving a safe and hygienic use.

To achieve the above purpose, the present invention adopts the following technical solution:

An inner buffering structure of a helmet comprising an air bladder, wherein the air bladder comprises a detachable inner-layer air bladder and an outer-layer air bladder, and the inner-layer air bladder is used for being in contact with a user's head;

A plurality of ventilation openings are formed in the inner-layer air bladder and the outer-layer air bladder; the portions where the inner-layer air bladder and the outer-layer air bladder correspond to the ventilation openings are provided with inner convex edges extending towards the interior of the ventilation openings;

A first air valve is arranged on the inner-layer air bladder, a second air valve is arranged on the outer-layer air bladder, and a reserved hole allowing the first air valve to pass through is formed in the outer-layer air bladder.

In another aspect of the present invention, a fixing strap is arranged on the side surface of the outer-layer air bladder.

In another aspect of the present invention, a pulling portion extends downwards from the side surface of the outer-layer air bladder. An ear hole for allowing an ear to extend out is formed in the portion where the pulling portion corresponds to the user's ear, and one end of the fixing strap is fixed to the pulling portion.

In another aspect of the present invention, the outer edge of the outer-layer air bladder is provided with an outer convex edge, and the pulling portion is fixed on the outer convex edge.

In another aspect of the present invention, a hook-and-loop fastener is arranged between the inner-layer air bladder and the outer-layer air bladder.

In another aspect of the present invention, a snap fastener is arranged between the inner-layer air bladder and the outer-layer air bladder.

In another aspect of the present invention, the thickness of the inner-layer air bladder after being inflated is smaller than that of the outer-layer airbag after being inflated.

In another aspect of the present invention, the size of the ventilation openings of the inner-layer air bladder is smaller than that of the outer-layer air bladder, and the number of the ventilation openings of the inner-layer air bladder is larger than that of the outer-layer air bladder.

In another aspect of the present invention, the first air valve and the second air valve are flat air valves.

In another aspect of the present invention, the inner-layer air bladder and the outer-layer air bladder are made of TPU or PVC.

In another aspect of the present invention, the side surface of the outer-layer air bladder extends downwards to form an ear-covering portion, a plurality of hearing holes are formed in a portion where the ear-covering portion corresponds to the ear, and one end of the fixing strap is fixed to the ear-covering portion.

In another aspect of the present invention, the outer edge of the outer-layer air bladder is provided with an outer convex edge, and the ear-covering portion is fixed on the outer convex edge.

In another aspect of the present invention, the surface of the outer-layer air bladder is provided with a cloth layer for enhancing the strength.

In another aspect of the present invention, the cloth layer is attached to the surface of the outer-layer air bladder.

In another aspect of the present invention, the cloth layer is sewn with the outer-layer air bladder.

In another aspect of the present invention, the cloth layer is sewn on the inner convex edge of the outer-layer air bladder.

In another aspect of the present invention, the reserved hole and the second air valve are oppositely arranged on the outer-layer air bladder.

In another aspect of the present invention, a GPS positioner is arranged on the outer-layer air bladder.

Compared with the prior art, the present invention has the following advantages:

1. Ventilation openings in the inner-layer air bladder and the outer-layer air bladder allow air permeability to be sufficient so that the stuffiness can be avoided;
2. The inner-layer air bladder can be removed from the outer-layer air bladder for private use, which is safe and hygienic, can be deflated for being conveniently carried after the removal, and can then be placed in one's pocket;

3. The inner-layer air bladder can closely fit the user's head after being inflated, making the user feel more comfortable; the outer-layer air bladder has a large volume, achieving an ideal buffering effect;
4. The inner-layer air bladder is provided with a plurality of densely-distributed ventilation openings, allowing the inner-layer air bladder to form a plurality of soft protruding points; thus, a certain massage effect can be achieved, making the user's head feel more comfortable.

MARKING INSTRUCTIONS OF THE DRAWINGS

Figure 1:
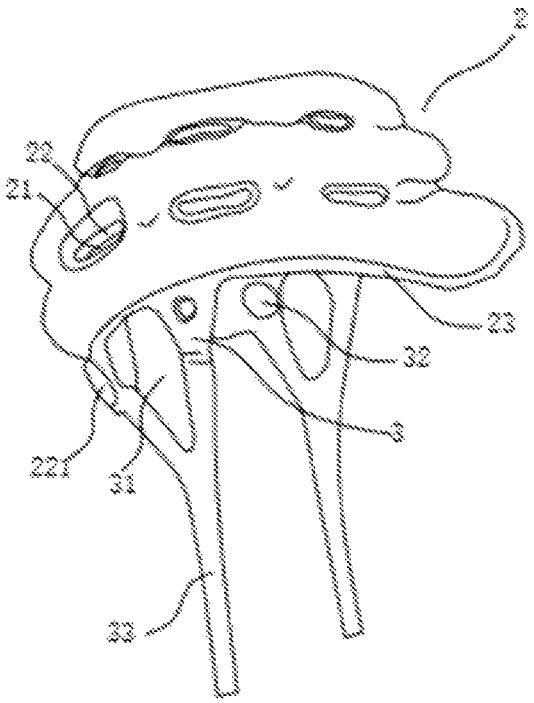
FIG. 1 is a three-dimensional structural diagram of the outer-layer air bladder in embodiment 1 of the present invention.

1—Inner-layer Air bladder, 112—The First Air Valve, 13—Small Protruding Point, 2—Outer-layer Air Bladder, 221—The Second Air Valve, 21—Ventilation Opening, 22—Inner Convex Edge, 23—Outer Convex Edge, 24—The First Air Chamber, 25—The Second Air Chamber, 26—Passage, 3—Pulling Portion, 31—Ear Hole, 32—Reserved Hole, 33—Fixing Strap, 3'—Ear-covering Portion, 31'—Hearing Hole.

DETAILED DESCRIPTION OF THE INVENTION

Detailed embodiments of the inner buffering structure of a helmet of the present invention are further described hereinafter with reference to FIGS. 1-4.

In the description of the present invention, it should be noted that the orientations and position relationships indicated by terms "center", "transverse (X)", "longitudinal (Y)", "vertical (Z)", "length", "width", "thickness", "upper", "lower", "front", "back", "left", "right", "upright", "horizontal", "top", "bottom", "inner", "outer", "clockwise" and "counterclockwise" are based on the orientations or position relationships shown in the figures. The aforesaid terms are only used for explaining the present invention and simplifying the description, but not for indicating or implying that the devices or elements have a specific orientation, or can be constructed and operated in a specific orientation. Therefore, the aforesaid terms cannot be understood as a limitation to the protection scope of the present invention.

Furthermore, the terms such as "first" and "second" are used for description only, which cannot be understood as an indication or implication of relative importance or number of implied technical features. Thus, features defined as "first" and "second" may expressly or implicitly include one or more features. In the present invention, unless explicitly stated, the terms "several" and "a plurality of" mean two or more.

Embodiment 1

An inner buffering structure of a helmet comprises an air bladder, wherein the air bladder comprises a detachable inner-layer air bladder 1 and an outer-layer air bladder 2, and the inner-layer air bladder 1 is used for being in contact with a user's head.

A plurality of ventilation openings 21 are formed in the inner-layer air bladder 1 and the outer-layer air bladder 2. The portions where the inner-layer air bladder 1 and the outer-layer air bladder 2 correspond to the ventilation openings 21 are provided with inner convex edges 22 extending towards the interior of the ventilation openings 21.

A first air valve 112 is arranged on the inner-layer air bladder 1, a second air valve 221 is arranged on the outer-layer air bladder 2, and a reserved hole 32 allowing the first air valve 112 to pass through is formed in the outer-layer air bladder 2.

Figure 2:
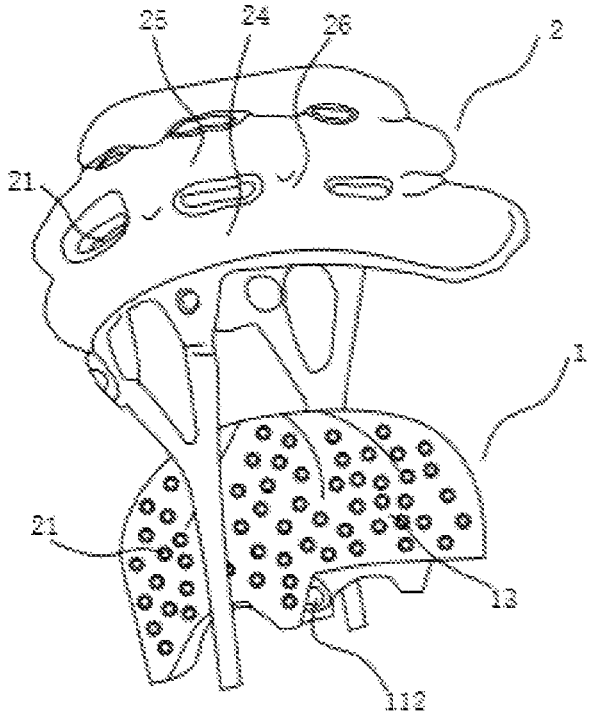
FIG. 2 is a three-dimensional diagram illustrating a structure before the inner-layer air bladder and the outer-layer air bladder in embodiment 1 of the present invention are assembled.
Figure 3:
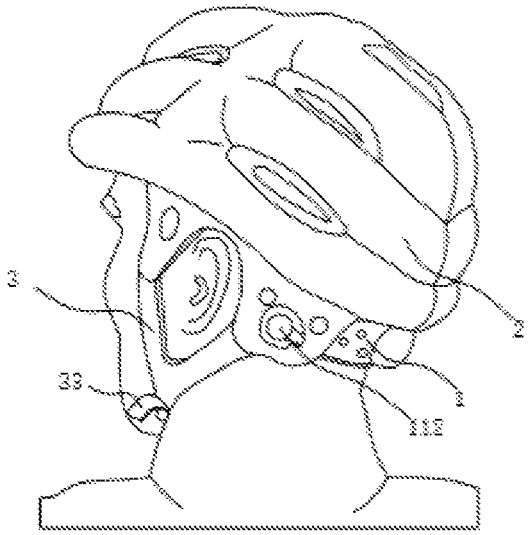
FIG. 3 is a structural diagram illustrating a state when the buffering structure in embodiment 1 of the present invention is used.

As shown in FIGS. 1 and 3, the ventilation openings 21 in the outer-layer air bladder 2 enable the outer-layer air bladder 2 to form a plurality of larger air chambers, and the air chambers are communicated with each other. When being impacted, the air in the air chamber being impacted is slowly transferred to an adjacent air chamber, achieving ideal buffering and supporting effects. As shown in FIG. 2, when a first air chamber 24 is impacted, the air in the first air chamber 24 enters a second air chamber 25 and other air chambers through a narrow passage 26, wherein when being impacted, the inner convex edge 22 can be folded and bent from a flat state, thereby providing a certain support. To a one-piece air chamber (no ventilation openings 21), when being impacted, the air in the portion being impacted is rapidly transferred to other portions, resulting in a poor buffering effect.

The outer-layer air bladder 2 is fixed in the shell. When used for indoor sliding-risk-free sports (e.g. jumping sports), the outer-layer air bladder 2 can be directly used for head protection without the shell. The user can inflate the inner-layer air bladder 1 through the second air valve 221 and fix the inner-layer air bladder 1 to the outer-layer air bladder 2, thereby allowing the user to wear the helmet. The air-inflation degree can be adjusted through the first air valve 112 and the second air valve 221, which allows the helmet to better fit the user's head. The inner-layer air bladder 1 serves the purposes of comfort and hygiene, and the inner-layer air bladder 1 and the outer-layer air bladder 2 achieve a good buffering effect at the same time. After use, the inner-layer air bladder 1 can be removed and deflated, allowing the user to conveniently collect and carry, and the outer-layer air bladder 2 is still fixed in the shell for being continuously used by the next user.

The first air valve 112 and the second air valve 221 are respectively located at the lower edge of the inner-layer air bladder 1 and the lower edge of the outer-layer air bladder 2, and the reserved hole 32 allows the first air valve 112 to extend out from it. Preferably, both the first air valve 112 and the second air valve 221 are located outside the shell, and the reserved hole 32 is located on the opposite side of the second air valve 221. Namely, when the helmet is worn, the positions of the first air valve 112 and the second air valve 221 are opposite. In the process of assembling the inner-layer air bladder 1 and the outer-layer air bladder 2, it's convenient to distinguish whether the assembly is correct or not, preventing the inner-layer air bladder 1 and the outer-layer air bladder 2 from being mistakenly assembled.

Preferably, the inner-layer air bladder 1 and the outer-layer air bladder 2 in this embodiment are made of TPU or PVC, and the first air valve 112 and the second air valve 221 are made of plastic.

In order to enhance the structural strength of the inner-layer air bladder 1 and the outer-layer air bladder 2, especially the structural strength of the outer-layer air bladder 2, a cloth material such as flannelette can be fixed on the surface of the outer-layer air bladder 2. The cloth material can be bonded to the surface of the outer-layer air bladder 2. During production, the surface of the cloth material and/or the surface of the outer-layer air bladder 2 are/is coated with glue, allowing the cloth material and the outer-layer air bladder 2 to be bonded and fixed. Alternatively, the cloth material is sewn with the outer-layer air bladder 2. If the cloth material is directly sewn at a position where the air chamber of the outer-layer air bladder 2 is located, in order to prevent the air from leaking from the sewn holes, glue or hot air can be adopted for sealing the sewn holes after sewing. Certainly, during sewing, the cloth material is preferably sewn on the inner convex edge 22 of the outer-layer air bladder 2. At this point, the sewn holes are not in the air chamber, avoiding the air leakage of the outer-layer air bladder caused by the sewn holes. The cloth material of this embodiment can effectively protect the outer-layer air bladder, prolong the functional life of the outer-layer air bladder, limit the maximum expansion volume of the outer-layer air bladder, and prevent the explosion of the outer-layer air bladder caused by the excessive inflation during the inflating process. The inner-layer air bladder 1 can be used for fixing the corresponding cloth material.

For the inner-layer air bladder 1 and the outer-layer air bladder 2 of the present invention are independent air chambers, when the outer-layer air bladder 2 is impacted by an external force, the outer-layer air bladder 2 and the inner-layer air bladder 1 can provide protection to the user's head. As the independent air chambers of the inner-layer air bladder 1 can provide a thorough protection to the user's head, when receiving an impact force, the independent-air-chamber-structure of the inner-layer air bladder 1 can make an instantaneous rebound force to the outer-layer air bladder 2, thereby alleviating the impact force received by the user's head.

Preferably, a fixing strap 33 is arranged on the side surface of the outer-layer air bladder 2. In this embodiment, there're two fixing straps 33. The two fixing straps 33 can be fixed by using a hook-and-loop fastener, an adjustable band or other existing technologies. In this way, the outer-layer air bladder 2 and the inner-layer air bladder 1 can be firmly fixed to the user's head.

Preferably, in this embodiment, a pulling portion 3 extends downwards from the side surface of the outer-layer air bladder 2. An ear hole 31 for allowing an ear to extend out is formed in the portion where the pulling portion 3 corresponds to the user's ear, and one end of the fixing strap 33 is fixed to the pulling portion 3.

As shown in FIG. 3, the pulling part 3 is integrally triangle-shaped, which increases the contact and stress areas between the pulling portion 3 and the outer-layer air bladder 2. In this way, the outer-layer air bladder 2 can be prevented from being damaged by single point tension, and the twist deformation of the outer-layer air bladder 2 caused by single point tension can be avoided.

The pulling portion 3 and the fixing strap 33 in this embodiment are preferably made of cloth, the outer edge of the outer-layer air bladder 2 is provided with an outer convex edge 23, and the pulling portion 3 is fixed on the outer convex edge 23.

In this embodiment, the reserved hole 32 is preferably formed in the pulling portion 3.

Preferably, in this embodiment, a hook-and-loop fastener is arranged between the inner-layer air bladder 1 and the outer-layer air bladder 2, or a snap fastener is arranged between the inner-layer air bladder 1 and the outer-layer air bladder 2, which enables the inner-layer air bladder 1 and the outer-layer air bladder 2 to be assembled and disassembled quickly. Certainly, other simple structures can be adopted for assembly.

In this embodiment, the thickness of the inner-layer air bladder 1 after being inflated is preferably smaller than that of the outer-layer airbag 2 after being inflated. The thickness of the outer-layer air bladder 2 is sufficient, achieving a good buffering effect of the outer-layer air bladder 2 when being impacted.

Preferably, in this embodiment, the size of the ventilation openings 21 of the inner-layer air bladder 1 is smaller than that of the outer-layer air bladder 2, and the number of the ventilation openings 21 of the inner-layer air bladder 1 is larger than that of the outer-layer air bladder 2. A plurality of soft small protruding points 13 are formed among the plurality of ventilation openings 21 of the inner-layer air bladder 1, enabling the inner-layer air bladder 1 to be relatively flat. In this way, the inner-layer air bladder 1 can sufficiently closely fit the user's head, making the user feel more comfortable and softer.

In this embodiment, the first air valve 112 and the second air valve 221 are preferably flat air valves, thereby greatly reducing the space occupation.

Preferably, in this embodiment, a GPS positioner is arranged on the outer-layer air bladder 2, and the GPS positioner is preferably arranged at the rear side of the outer-layer air bladder, allowing the helmet to be conveniently found by a user or a manager when being used as a shared helmet.

Embodiment 2

Figure 4:
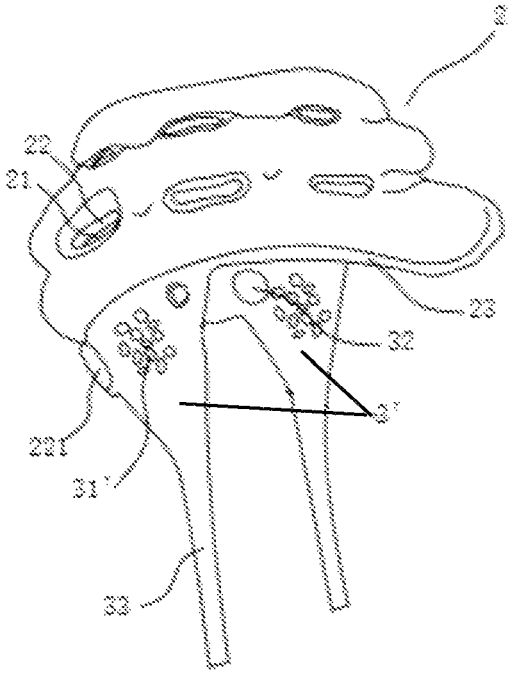
FIG. 4 is a three-dimensional diagram illustrating a structure before the inner-layer air bladder and the outer-layer air bladder in embodiment 2 of the present invention are assembled.

As shown in FIG. 4, in this embodiment, the side surface of the outer-layer air bladder 2 extends downwards to form an ear-covering portion 3', and the width of the ear-covering portion is gradually reduced downwards from the outer-layer air bladder 2. The ear-covering portion 3' is integrally triangle-shaped. A plurality of hearing holes 31' (can also be called sound holes) are formed in a portion where the ear-covering portion corresponds to the ear (the position where the ear is located when the helmet is worn). One end of the fixing strap 33 is fixed to the ear-covering portion. The other technical features are the same as that of embodiment 1.

In this embodiment, the aperture of the hearing hole 31' is far smaller than that of the ear hole 31. When the user wears the helmet, the user's ears are covered by the ear-covering portions, and the user can clearly hear the sound outside through the hearing holes. During use, not only can the user's ears be protected, but also the outside can be sensed by the user, achieving a safe use.

The above description is only the preferred embodiments of the present invention and does not limit the patent scope of the present invention, any equivalent structure or equivalent process modification used according to the contents of the specification and accompanying drawings in the present invention, no matter whether it is directly or indirectly used in any other related technical field, should be included within the protection scope of the present invention.

The invention claimed is:

1. An inner buffering structure for a helmet, comprising: an air bladder, wherein the air bladder comprises a detachable inner-layer air bladder and an outer-layer air bladder, wherein the inner-layer air bladder is configured to be in contact with a user's head, wherein a plurality of ventilation openings are formed in the inner-layer air bladder and the outer-layer air bladder, wherein the portions where the inner-layer air bladder and the outer-layer air bladder correspond to the ventilation openings are provided with inner convex edges extending towards the interior of the ventilation openings, wherein a first air valve is arranged on the inner-layer air bladder, a second air valve is arranged on the outer-layer air bladder, and a reserved hole is formed in the outer-layer air bladder and is configured to allow the first air valve to pass through the said hole is formed in the outer-layer air bladder.

2. The inner buffering structure for a helmet of claim 1, wherein a fixing strap is arranged on a side surface of the outer-layer air bladder.

3. The inner buffering structure for a helmet of claim 2, wherein a pulling portion extends downwards from the side surface of the outer-layer air bladder, wherein an ear hole for allowing an ear to extend out is formed in a portion configured to correspond to the user's ear when the inner buffering structure is worn, and one end of the fixing strap is fixed to the pulling portion.

4. The inner buffering structure for a helmet of claim 3, wherein the outer edge of the outer-layer air bladder is provided with an outer convex edge, and the pulling portion is fixed on the outer convex edge.

5. The inner buffering structure for a helmet of claim 2, wherein the side surface of the outer-layer air bladder extends downwards to form an ear-covering portion, a plurality of hearing holes are formed in in the ear-covering portion such that the hearing holes are configured to correspond to a user's ear, and one end of the fixing strap is fixed to the ear-covering portion.

6. The inner buffering structure for a helmet of claim 5, wherein outer edge of the outer-layer air bladder is provided with an outer convex edge, and the ear-covering portion is fixed on the outer convex edge.

7. The inner buffering structure for a helmet of claim 1, wherein a hook-and-loop fastener is arranged between the inner-layer air bladder and the outer-layer air bladder.

8. The inner buffering structure for a helmet of claim 1, wherein a snap fastener is arranged between the inner-layer air bladder and the outer-layer air bladder.

9. The inner buffering structure for a helmet of claim 1, wherein a thickness of the inner-layer air bladder is configured to be smaller than that of the outer-layer air bladder upon inflation of the inner-layer and outer-layer air bladder.

10. The inner buffering structure for a helmet of claim 9, wherein a size of the ventilation openings of the inner-layer air bladder is smaller than that of the outer-layer air bladder, and the number of the ventilation openings of the inner-layer air bladder is larger than that of the outer-layer air bladder.

11. The inner buffering structure for a helmet of claim 1, wherein the first air valve and the second air valve are flat air valves.

12. The inner buffering structure for a helmet of claim 1, wherein the inner-layer air bladder and the outer-layer air bladder are made of TPU or PVC.

13. The inner buffering structure for a helmet of claim 1, wherein the a surface of the outer-layer air bladder is provided with a cloth layer for enhancing the strength of the outer-layer air bladder.

14. The inner buffering structure for a helmet of claim 13, wherein the cloth layer is attached to a surface of the outer-layer air bladder.

15. The inner buffering structure for a helmet of claim 13, wherein the cloth layer is sewn with the outer-layer air bladder.

16. The inner buffering structure for a helmet of claim 15, wherein the cloth layer is sewn on the inner convex edge of the outer-layer air bladder.

17. The inner buffering structure for a helmet of claim 1, wherein the reserved hole and the second air valve are oppositely arranged on the outer-layer air bladder.

18. The inner buffering structure for a helmet of claim 1, wherein a GPS positioner is arranged on the outer-layer air bladder.

* * * * *